US009181622B2

(12) United States Patent
Middeke

(10) Patent No.: US 9,181,622 B2
(45) Date of Patent: Nov. 10, 2015

(54) PROCESS FOR METALLIZING NONCONDUCTIVE PLASTIC SURFACES

(71) Applicant: Atotech Deutschland GmbH, Berlin (DE)

(72) Inventor: Hermann Middeke, Falkensee (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/376,857

(22) PCT Filed: Mar. 15, 2013

(86) PCT No.: PCT/EP2013/055356
§ 371 (c)(1),
(2) Date: Aug. 6, 2014

(87) PCT Pub. No.: WO2013/135862
PCT Pub. Date: Sep. 19, 2013

(65) Prior Publication Data

US 2015/0001177 A1 Jan. 1, 2015

(30) Foreign Application Priority Data

Mar. 15, 2012 (EP) ..... 12159652

(51) Int. Cl.

| | |
|---|---|
| ***C23C 18/16*** | (2006.01) |
| ***C23C 18/22*** | (2006.01) |
| ***C23C 18/24*** | (2006.01) |
| ***C23C 18/52*** | (2006.01) |

(52) U.S. Cl.
CPC ..... *C23C 18/1603* (2013.01); *C23C 18/163* (2013.01); *C23C 18/166* (2013.01); *C23C 18/1625* (2013.01); *C23C 18/1641* (2013.01); *C23C 18/22* (2013.01); *C23C 18/24* (2013.01); *C23C 18/52* (2013.01)

(58) Field of Classification Search
CPC ..... C23C 18/22–18/24; C23C 18/1641; H05K 3/382
See application file for complete search history.

(56) References Cited

U.S. PATENT DOCUMENTS

| | | | | |
|---|---|---|---|---|
| 4,448,811 | A | 5/1984 | Doty et al. | |
| 4,610,895 | A * | 9/1986 | Tubergen et al. | 427/99.1 |
| 5,591,354 | A * | 1/1997 | Patel et al. | 216/83 |
| 2015/0017331 | A1* | 1/2015 | Middeke et al. | 427/304 |
| 2015/0064346 | A1* | 3/2015 | Middeke et al. | 427/98.8 |

FOREIGN PATENT DOCUMENTS

| | | |
|---|---|---|
| DE | 3248000 | 7/1983 |
| EP | 1001052 | 5/2000 |
| EP | 1942207 | 7/2008 |

OTHER PUBLICATIONS

PCT/EP2013/055356; PCT International Search Report and Written Opinion of the International Searching Authority dated Sep. 10, 2013.

* cited by examiner

*Primary Examiner* — Duy Deo
(74) *Attorney, Agent, or Firm* — Renner, Otto, Boisselle & Sklar, LLP

(57) ABSTRACT

The present invention relates to a process for metallizing electrically nonconductive plastic surfaces of articles. During the process, the rack to which the said articles are fastened is subjected to a treatment for protection against metallization. Subsequently, the articles are metallized by means of known processes, wherein the racks remain free of metal.

20 Claims, 4 Drawing Sheets

PROCESS FOR METALLIZING NONCONDUCTIVE PLASTIC SURFACES

The present application is a U.S. National Stage Application based on and claiming benefit and priority under 35 U.S.C. §371 of International Application No. PCT/EP2013/055356, filed 15 Mar. 2013, which in turn claims benefit of and priority to European Application No. 12159652.2 filed 15 Mar. 2012, the entirety of each of which is hereby incorporated herein by reference.

FIELD OF THE INVENTION

The present invention relates to a process for metallizing electrically nonconductive plastic surfaces of articles. During the process, the rack in which the said articles are fastened is treated with an iodate ion-containing solution in order to prevent metallization of the rack. After the treatment with the iodate ion-containing solution, the articles can be metallized by means of known processes. In the course of these, the rack remains free of metal.

BACKGROUND OF THE INVENTION

Articles made from electrically nonconductive plastic can be metallized by an electroless metallization process. In this process, the article is first cleaned and etched, then treated with a noble metal and finally metallized. The etching is typically undertaken by means of chromosulphuric acid. The etching serves to make the surface of the article receptive to the subsequent metallization, such that the surfaces of the articles are well-wetted with the respective solutions in the subsequent treatment steps and the deposited metal ultimately has sufficiently firm adhesion on the surface.

For etching, the surface of articles, for example made from acrylonitrile-butadiene-styrene copolymer (ABS copolymer), is etched using chromosulphuric acid, so as to form surface microcaverns in which metal is deposited and subsequently adheres there firmly. After the etching, the plastic is activated for the electroless metallization by means of an activator comprising a noble metal, and then metallized electrolessly. Subsequently, a thicker metal layer can also be applied electrolytically.

Etching solutions based on chromosulphuric acid, however, are toxic and should therefore be replaced as possible.

The literature describes attempts to replace etching solutions based on chromosulphuric acid with those comprising permanganate salts.

The use of permanganates in an alkaline medium for metallization of circuit boards as a carrier of electronic circuits has long been established. Since the hexavalent state (manganate) which arises in the oxidation is water-soluble and has sufficient stability under alkaline conditions, the manganate, similarly to trivalent chromium, can be oxidized electrolytically back to the original oxidizing agent, in this case the permanganate. The document DE 196 11 137 A1 describes the use of the permanganate also for metallization of other plastics as circuit board material. For the metallization of ABS plastics, a solution of alkaline permanganate has been found to be unsuitable since it was not possible in this way to obtain a reliable, sufficient adhesion strength between metal layer and plastic substrate. This adhesion strength is determined in the "peel test". It should have at least a value of 0.4 N/mm.

EP 1 0010 52 discloses an acidic permanganate solution which is said to be suitable for use in plastic galvanization. EP 1 0010 52 does not report the adhesion strengths achievable by this pretreatment. In-house experiments have shown that the adhesion strengths are below a value of 0.4 N/mm. Moreover, the solutions described in EP 1 0010 52 are unstable. A constant quality of the metallization therefore cannot be achieved.

As an alternative to chromosulphuric acid, WO 2009/023628 A2 proposes strongly acidic solutions comprising an alkali metal permanganate salt. The solution contains about 20 g/l alkali metal permanganate salt in 40-85% by weight phosphoric acid. Such solutions form colloidal manganese (IV) species which are difficult to remove. According to WO 2009/023628 A2, the effect of the colloids even after a short time is that coating of adequate quality is no longer possible. To solve the problem, WO 2009/023628 A2 proposes using manganese(VII) sources which do not contain any alkali metal or alkaline earth metal ions. However, the preparation of such manganese(VII) sources is costly and inconvenient.

Therefore, toxic chromosulphuric acid is still being used for etching treatment of plastics.

For industrial scale application of metallization of plastic surfaces, the articles are usually fastened to racks. These are metal carrier systems which allow the simultaneous treatment of a large number of articles with the successive solutions for the individual process steps, and last steps for electrolytic deposition of one or more metal layers. The racks are generally themselves coated with plastic. Therefore, the racks in principle likewise constitute a substrate for metallization processes on plastic surfaces.

However, the additional metallization of the racks is undesirable, since the metal layers have to be removed again from the racks after the coating of the articles. This means additional cost and inconvenience for the removal, combined with additional consumption of chemicals. Moreover, the productivity of the metallization plant in this case is lower, since the racks first have to be demetallized prior to reloading with articles. If the demetallization has to take place using semi-concentrated hydrochloric acid and/or using nitric acid, vapours and aerosols are produced, and these lead to corrosion in the environment.

A further problem is that, when rack metallization occurs, it is no longer possible to achieve a defined current density in a reproducible manner because the extent of the rack coverage is usually unknown, and the exact surface area of the rack is likewise unknown. The consequence is then usually that the metal layer applied to the galvanized plastic articles is too thin.

In the case of use of chromic acid-containing etchants, this problem is much reduced. During the etching, chromic acid also penetrates into the plastic casing of the racks and diffuses back out of it during the subsequent process steps, thus preventing metallization of the rack.

Thus, if the intention is to replace toxic chromosulphuric acid for etching treatment of plastics with environmentally safe process steps, it becomes necessary to prevent unwanted metallization of the racks.

Patent DE 195 10 855 C2 describes a process for selective or partial electrolytic metallization of nonconductive materials. In this case, the simultaneous metallization of the racks is prevented by omitting treatment steps with adsorption-promoting solutions, called conditioners. However, it is emphasized that the process for metallizing nonconductive materials in DE 195 10 855 C2 is suitable only for direct metallization.

DESCRIPTION OF THE INVENTION

Figure 1:
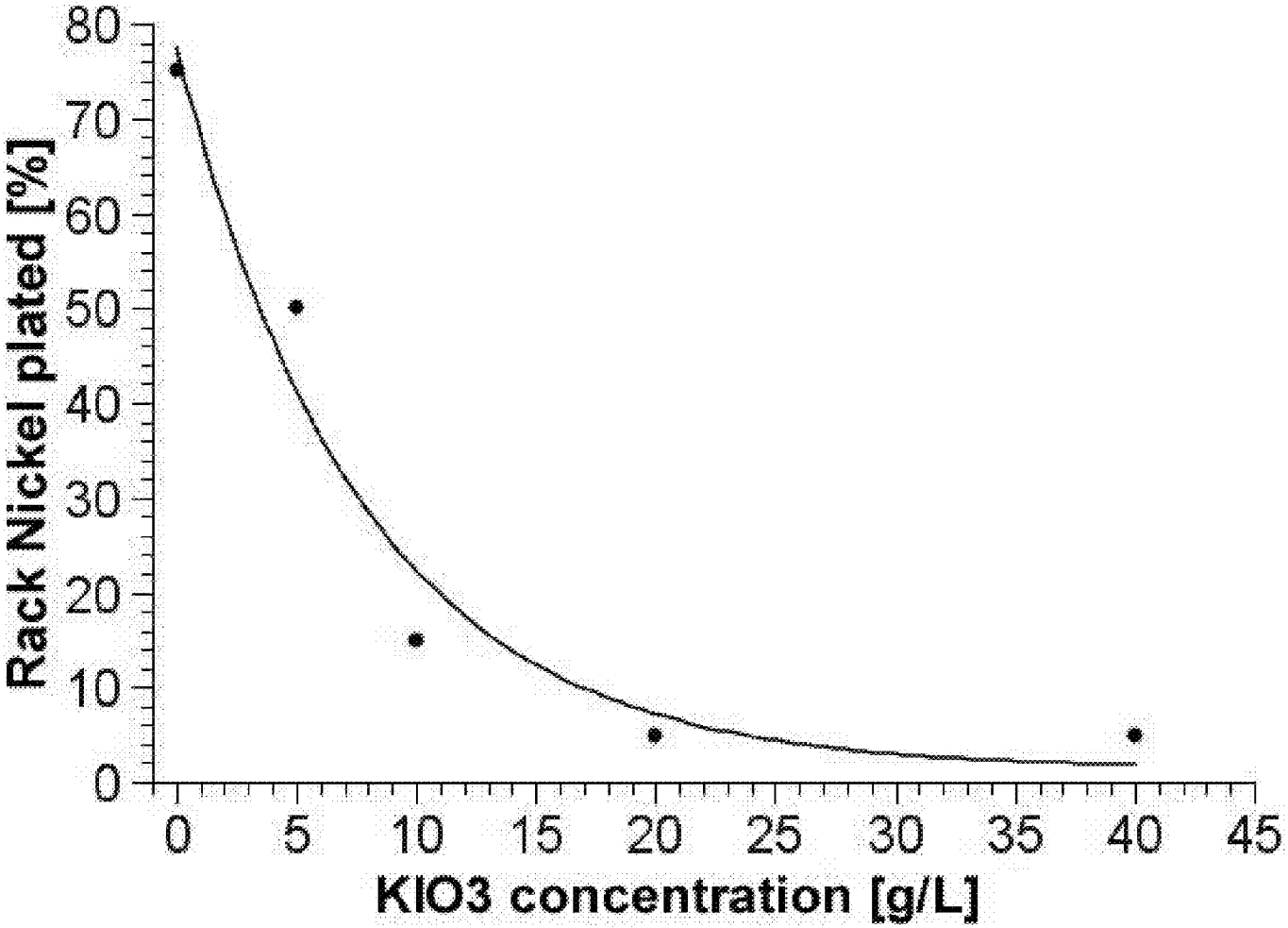
FIG. 1: Influence of the iodate treatment on rack metallization.

The present invention is therefore based on the problem that it has not been possible to date to avoid the metallization of the racks and simultaneously to achieve metallization of articles made from electrically nonconductive plastic with sufficient process reliability and adhesion strength of the metal layers applied subsequently.

It is therefore an object of the present invention to prevent the metallization of the racks while electrically nonconductive plastic surfaces of articles are being metallized.

This object is achieved by the following process according to the invention: Process for metallizing electrically nonconductive plastic surfaces of articles, comprising the process steps of:

A) fastening the article to a rack,

B) etching the plastic surface with an etching solution;

C) treating the plastic surface with a solution of a metal colloid or of a compound of a metal, the metal being selected from the metals of transition group I of the Periodic Table of the Elements and transition group VIII of the Periodic Table of the Elements, and D) metallizing the plastic surface with a metallizing solution;

characterized in that the rack is treated with a solution comprising iodate ions.

Articles in the context of this invention are understood to mean articles which have been manufactured from at least one electrically nonconductive plastic or which have been covered with at least one layer of at least one electrically nonconductive plastic. The articles thus have surfaces of at least one electrically nonconductive plastic. Plastic surfaces are understood in the context of this invention to mean these said surfaces of the articles.

The process steps of the present invention are performed in the sequence specified, but not necessarily in immediate succession. It is possible for further process steps and additionally rinse steps in each case, preferably with water, to be performed between the steps.

The inventive treatment of the rack with a solution comprising iodate ions prevents the metallization of the rack, while the electrically nonconductive plastic surfaces of articles are coated with metal. The rack thus remains free of metal during the process according to the invention. With the process according to the invention, it is unnecessary to free the racks of metal again after use, since the racks are not metallized as a result of the inventive treatment with iodate ions and thus remain free of metal. Thus, after the performance of the metallization process and the removal of the metallized articles from the racks, the racks can be returned immediately back to the production cycle without further treatment and used for metallization of further articles.

No additional cleaning and etching steps are necessary for demetallization of the racks. This also reduces the expenditure for wastewater disposal. In addition, a smaller amount of chemicals is consumed. The productivity of the metallization plant is also enhanced, since, with a given number of racks available, a greater number of articles for metallization can be treated.

The plastic surfaces have been manufactured from at least one electrically nonconductive plastic. In one embodiment of the present invention, the at least one electrically nonconductive plastic is selected from the group comprising an acrylonitrile-butadiene-styrene copolymer (ABS copolymer), a polyamide (PA), a polycarbonate (PC) and a mixture of an ABS copolymer with at least one further polymer.

In a preferred embodiment of the invention, the electrically nonconductive plastic is an ABS copolymer or a mixture of an ABS copolymer with at least one further polymer. The at least one further polymer is more preferably polycarbonate (PC), which means that particular preference is given to ABS/PC mixtures.

The inventive treatment of the rack with a solution comprising iodate ions is also referred to hereinafter as protection of the rack. The protection of the rack can take place at various times during the process according to the invention. In a preferred embodiment of the present invention, the treatment of the rack with a solution comprising iodate ions takes place prior to process step A).

At this time, the articles are not yet fastened to the rack. The rack is thus treated alone, without the articles, with the solution comprising iodate ions.

Step A) of the process according to the invention is the fastening of the articles to racks which enable the simultaneous treatment of a large number of articles with the successive solutions for the individual process steps, and the establishment of electrical contact connection during the last steps for electrolytic deposition of one or more metal layers. The treatment of the articles by the process according to the invention is preferably performed in a conventional dipping process, by dipping the articles successively into solutions in vessels in which the respective treatment takes place. In this case, the articles may be dipped into the solutions either fastened to racks or accommodated in drums. Fastening to racks is preferred. The racks are generally themselves coated with plastic. The plastic is usually polyvinyl chloride (PVC).

In a further embodiment of the invention, the following further process step is performed between process steps A) and B):

A i) treating the plastic surface in an aqueous solution comprising at least one glycol compound.

The further process step A i) is also referred to as pretreatment step. This pretreatment step increases the adhesion strength between the plastic of the article and the metal layer.

A glycol compound is understood to mean compounds of the following general formula (I):

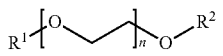

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —CH $(CH_3)—CH_2—CH_2—CH_3$, $—CH_2—CH(CH_3)—CH_2—CH_3$, $—CH_2—CH_2—CH(CH_3)—CH_3$, $—CH(CH_2—CH_3)—CH_2—CH_3$, $—CH_2—CH(CH_2—CH_3)—CH_3$, $—CO—CH_3$, $—CO—CH_2—CH_3$, $—CO—CH_2—CH_2—CH_3$, $—CO—CH(CH_3)—CH_3$, $—CO—CH(CH_3)—CH_2—CH_3$, $—CO—CH_2—CH(CH_3)—CH_3$, $—CO—CH_2—CH_2—CH_2—CH_3$.

According to the general formula (I), the glycol compounds include the glycols themselves and glycol derivatives. The glycol derivatives include the glycol ethers, the glycol esters and the glycol ether esters. The glycol compounds are solvents.

Preferred glycol compounds are ethylene glycol, diethylene glycol, ethylene glycol monomethyl ether acetate, ethylene glycol monoethyl ether acetate, ethylene glycol monopropyl ether acetate, ethylene glycol acetate, diethylene glycol monoethyl ether acetate, diethylene glycol monomethyl ether acetate, diethylene glycol monopropyl ether acetate, butyl glycol, ethylene glycol monobutyl ether, ethylene glycol diacetate and mixtures thereof. Particular preference is given to diethylene glycol monoethyl ether acetate, ethylene glycol acetate, ethylene glycol diacetate, butyl glycol and mixtures thereof.

In the case of use of glycol esters and glycol ether esters, it is advisable to keep the pH of the aqueous solution of the glycol compound within the neutral range by suitable measures, in order to as far as possible suppress the hydrolysis to give the alcohol and carboxylic acid. One example is the hydrolysis of the diethylene glycol monoethyl ether acetate:

$$CH_3—CO—O—CH_2CH_2—O—CH_2CH_2—O—CH_2CH_3+H_2O \rightarrow CH_3—COOH+HO—CH_2CH_2—O—CH_2CH_2—O—CH_2CH_3$$

The water concentration of the solution comprising a glycol compound likewise has an influence on the hydrolysis of the glycol esters and glycol ether esters. However, the solution has to contain water for two reasons: firstly to obtain a noncombustible treatment solution and secondly to be able to adjust the strength of the attack on the plastic surface. A pure solvent, i.e. 100% of a glycol compound, would dissolve most uncrosslinked polymers or at least leave an unacceptable surface. It has therefore been found to be very advantageous to buffer the solution of a glycol ester or glycol ether ester and thus to keep it within the neutral pH range, which means scavenging the protons obtained by hydrolysis of the solvent. A phosphate buffer mixture has been found to be sufficiently suitable for this purpose. The readily soluble potassium phosphates allow sufficiently high concentrations with good buffer capacity at solvent concentrations up to 40% by vol.

The optimal treatment time for the plastic surface depends on the plastic used, the temperature, and the nature and concentration of the glycol compound. The treatment parameters have an influence on the adhesion between the treated plastic surface and the metal layer applied in downstream process steps. Higher temperatures or concentrations of the glycol compounds also influence the texture of the plastic surface. In any case, it should be possible for the downstream etching step B) to remove the solvent from the plastic matrix again, because the subsequent steps in the process, more particularly the activation in process step C), are otherwise disrupted.

The process according to the invention gives adhesion strengths of at least 0.8 N/mm, which is well above the required minimum value of 0.4 N/mm. The treatment time in process step A i) is between 1 and 30 minutes, preferably between 5 and 20 minutes and more preferably between 7 and 15 minutes.

The treatment temperature is between 20° C. and 70° C., depending on the nature of the solvent or solvent mixture used. Preference is given to a treatment temperature between 20° C. and 50° C., particular preference to a treatment temperature between 20° C. and 45° C.

The treatment of the plastic surfaces in process step A i) can be performed in an aqueous solution comprising one glycol compound or in an aqueous solution comprising two or more different glycol compounds. The total concentration of glycol compounds in the aqueous solution is 5% by vol.-50% by vol., preferably 10% by vol.-40% by vol. and more preferably 20% by vol.-40% by vol. If said solution contains one glycol compound, the overall concentration corresponds to the concentration of this one glycol compound. If said solution contains two or more different glycol compounds, the total concentration corresponds to the sum total of the concentrations of all glycol compounds present. In the context of the solution containing at least one glycol compound, the concentration figures for the glycol compound/glycol compounds in % are always understood to mean a concentration in % by vol.

For instance, for pretreatment of ABS plastic surfaces, a solution of 15% by vol. of diethylene glycol monoethyl ether acetate in a mixture with 10% by vol. of butyl glycol at 45° C. has been found to be advantageous (see Example 4). The first solvent therein serves to generate the adhesion strength, while the second, as a nonionic surfactant, increases wettability and helps to remove any soiling present from the plastic surface.

For pretreatment of ABS/PC mixtures, for example Bayblend T45 or Bayblend T65PG, a solution of 40% by vol. of diethylene glycol monoethyl ether acetate in water at room temperature has been found to be more advantageous, because it allows a higher adhesion strength of the metal layers applied in the case of these plastics (see Example 5).

In a further preferred embodiment of the present invention, the treatment of the rack with a solution comprising iodate ions takes place between process steps A) and B). In this case, the treatment of the rack with a solution comprising iodate ions can take place between process steps A) and A i) or between process steps A i) and B).

At these times, the articles have already been fastened to the rack. The rack is thus treated together with the articles with the solution comprising iodate ions.

The wordings "the rack is treated with a solution comprising iodate ions" and "treatment of the rack with a solution comprising iodate ions" in the context of this invention mean that the protection of the rack can take place alone, without the articles (for example when the protection of the rack takes place prior to process step A)), or that the protection of the rack can take place together with the articles (for example when the protection of the rack takes place at some time after process step A)).

Irrespective of whether the protection of the rack takes place alone or together with the articles, it leads to special protection of the plastic casing of the racks against metal deposition while the articles which are fastened to the racks during process step A) are being metallized. The protection of the rack ensures that the plastic casing of the racks is not metallized in the later process steps C) to D), meaning that the racks remain free of metal. This effect is particularly pronounced on a PVC casing of the racks.

The etching treatment in process step B) is performed in an etching solution. The etching solution comprises a source for permanganate ions. The source for permanganate ions is selected from alkali metal permanganates. The alkali metal permanganates are selected from the group comprising potassium permanganate and sodium permanganate. The source for permanganate ions is present in the etching solution in a concentration between 30 g/l and 250 g/l, preferably between 30 g/l and 180 g/l, further preferably between 90 g/l and 180 g/l, more preferably between 90 g/l and 110 g/l and even more preferably between 70 g/l and 100 g/l. Owing to its solubility, potassium permanganate may be present in the etching solution in a concentration of up to 70 g/l. Sodium permanganate may be present in the etching solution in a concentration of up to 250 g/l. The lower concentration limit for each of these two salts is typically 30 g/l. The content of sodium permanganate is preferably between 90 g/l and 180 g/l.

The etching solution is preferably acidic, meaning that it preferably contains an acid. Surprisingly, alkaline permanganate solutions, as used routinely in the circuit board industry as an etching solution, are unsuitable for the present invention, since they do not give sufficient adhesion strength between plastic surface and metal layer.

Acids which are used in the etching solution are preferably inorganic acids. The inorganic acid in the etching solution in process step B) is selected from the group comprising sulphuric acid, nitric acid and phosphoric acid. The acid concentration must not be too high, since the etching solution is otherwise not stable. The acid concentration is between 0.02-0.6 mol/l based on a monobasic acid. It is preferably between 0.06 and 0.45 mol/l, more preferably between 0.07 and 0.30 mol/l, based in each case on a monobasic acid. Preference is given to using sulphuric acid in a concentration between 0.035 and 0.15 mol/l, corresponding to an acid concentration between 0.07 and 0.30 mol/l based on a monobasic acid.

In a further embodiment the etching solution does only contain a source for permanganate ions as described above and an acid as described above. In this embodiment the etching solution does not contain any further ingredients.

The etching solution can be employed at temperatures between 30° C. and 90° C., preferably between 55° C. and 75° C. It has been found that sufficiently high adhesion strengths between metal layers and plastic surfaces can also be achieved at low temperatures between 30° C. and 55° C. In that case, however, it is not possible to ensure that all solvent from the treatment with glycol compound in process step A i) has been removed from the plastic surface. This is particularly true of pure ABS. Thus, if step A i) in the process according to the invention is executed, the temperatures in the downstream process step B) should be selected at a higher level, namely within the range from 55° C. to 90° C., preferably within the range from 55° C. to 75° C. The optimal treatment time depends on the plastic surface being treated and the selected temperature of the etching solution. For ABS and ABS/PC plastic surfaces, the best adhesion strength between plastic surface and subsequently applied metal layer is achieved at a treatment time between 5 and 30 minutes, preferably between 10 and 25 minutes and more preferably between 10 and 15 minutes. A longer treatment time than 30 minutes generally leads to no further improvement in the adhesion strengths.

An acidic permanganate solution is very reactive at elevated temperatures, for example at 70° C. The oxidation reaction with the plastic surface then forms many manganese (IV) species which precipitate out. These manganese(IV) species are predominantly manganese(IV) oxides or oxide hydrates and are referred to hereinafter simply as manganese dioxide.

The manganese dioxide precipitate has a disruptive effect on the subsequent metallization if it remains on the plastic surface. During the activation in process step C), it ensures that regions of the plastic surface are not covered with metal colloid or gives rise to unacceptable roughness of the metal layer to be applied in later process steps.

The etching solution does not contain any chromium or chromium compounds; the etching solution contains neither chromium(III) ions nor chromium(VI) ions. The etching solution is thus free of chromium or chromium compounds; the etching solution is free of chromium(III) ions and chromium(VI) ions.

In a further embodiment, the articles, after the permanganate treatment in process step B), are cleaned by rinsing off excess permanganate solution. The rinsing is effected in one or more, preferably three, rinsing steps with water.

In a further embodiment of the invention, the following further process step is performed between process steps B) and C):

B i) treating the plastic surface in a solution comprising a reducing agent for manganese dioxide.

The further process step B i) is also referred to as reduction treatment. This reduction treatment reduces manganese dioxide adhering to the plastic surfaces to water-soluble manganese(II) ions. The reduction treatment is conducted after the permanganate treatment in process step B) and optionally after the rinsing. For this purpose, an acidic solution of a reducing agent is used. The reducing agent is selected from the group comprising hydroxylammonium sulphate, hydroxylammonium chloride and hydrogen peroxide. Preference is given to an acidic solution of hydrogen peroxide because hydrogen peroxide is neither toxic nor complex-forming. The content of hydrogen peroxide in the solution of the reduction treatment (reduction solution) is between 25 ml/l and 35 ml/l of a 30% hydrogen peroxide solution (% by weight), preferably 30 ml/l of a 30% hydrogen peroxide solution (% by weight).

The acid used in the reduction solution is an inorganic acid, preferably sulphuric acid. The acid concentration is 0.5 mol/l to 5.0 mol/l, preferably 1.0 mol/l to 3.0 mol/l, more preferably 1.0 mol/l to 2.0 mol/l, based in each case on a monobasic acid. In the case of use of sulphuric acid, particular preference is given to concentrations of 50 g/l 96% sulphuric acid to 100 g/l 96% sulphuric acid, corresponding to an acid concentration of 1.0 mol/l to 2.0 mol/l based on a monobasic acid.

The reduction treatment removes the manganese dioxide precipitate which disrupts the metallization of the articles. As a result, the reduction treatment of process step B i) promotes the homogeneous and continuous coverage of the articles with the desired metal layer and promotes the adhesion strength and smoothness of the metal layer applied to the articles.

The reduction treatment in process step B i) likewise has an advantageous effect on the metallization of the plastic casing of the rack. The unwanted coverage of the plastic casing with palladium during process step C) is suppressed. This effect is particularly pronounced when the reduction solution comprises a strong inorganic acid, preferably sulphuric acid. Hydrogen peroxide is preferred over hydroxylammonium sulphate or chloride in the reduction solution also because it better suppresses rack metallization.

The reduction treatment in process step B i) is performed at a temperature between 30° C. and 50° C., preferably at 40° C. to 45° C. The reduction treatment is performed for a period between 1 and 10 minutes, preferably between 3 and 6 minutes. In order to achieve sufficient protection of the racks prior to activation, it is advantageous to increase the treatment time in the reduction solution to 3 to 10 minutes, preferably to 3 to 6 minutes.

The hydrogen peroxide reducing agent used has to be replenished from time to time. The consumption of hydrogen peroxide can be calculated from the amount of manganese dioxide bound to the plastic surfaces. In practice, it is sufficient to observe the evolution of gas in the course of the reduction reaction during process step A i) and to meter in the original amount of hydrogen peroxide, for example 30 ml/l of a 30% solution, when the evolution of gas abates. At elevated operating temperature of the reduction solution, for example at 40° C., the reaction is rapid and is complete after one minute at most.

In a further preferred embodiment of the present invention, the treatment of the rack with a solution comprising iodate ions takes place between process steps B) and C), preferably between process steps B i) and B ii).

In summary the treatment of the rack with a solution comprising iodate ions may take place prior to process step A) or take place between process steps A) and B) or take place between process steps B) and C).

The treatment of the rack with a solution comprising iodate ions is perfomed prior to process step C). Preferably the treatment of the rack with a solution comprising iodate ions is perfomed prior to process step B ii). If the treatment of the rack with a solution comprising iodate ions is performed at a time later than step C) during the inventive metallizing process, or simultaneously with step C), the effect of protection of the plastic casing of the racks against metal deposition is not achieved (see Example 6).

Irrespective of the time of protection of the rack among the times described in the process according to the invention, it leads to special protection of the plastic casing of the racks against the metal deposition, while the articles which are fastened to the racks during process step A) are metallized.

Figure 2A:
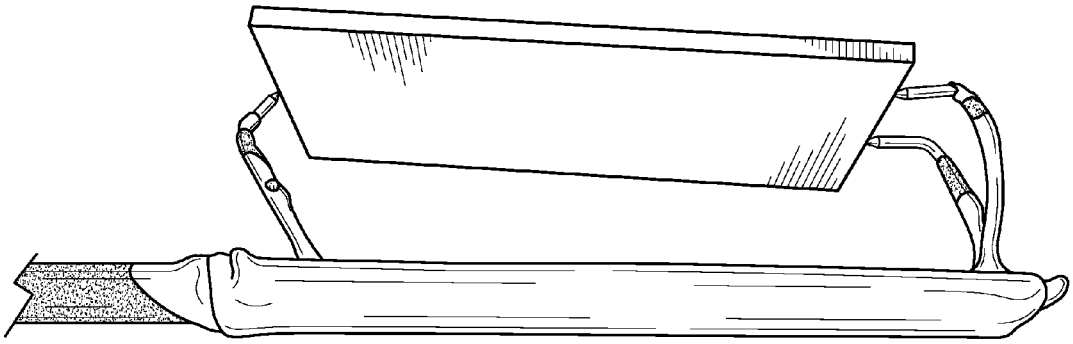
FIG. 2A: Rack after metallization process without iodate treatment.
Figure 2B:
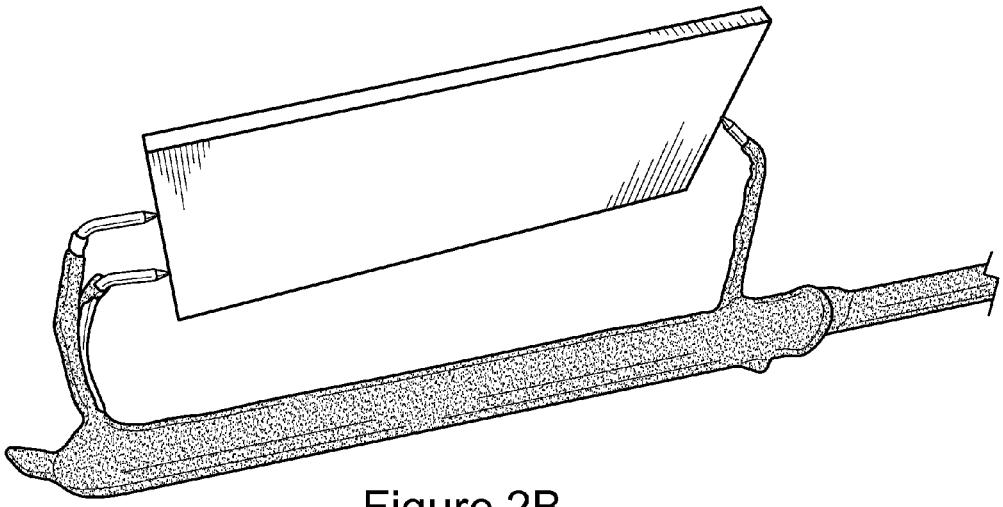
FIG. 2B: Rack after metallization process with iodate treatment.

The effect of the protection of the rack on the metallization of the racks is also shown in FIGS. 2A and 2B. FIG. 2A shows part of a rack after a plastic surface of an article in the form of a plate which has been fastened in the rack has been copper-plated. The process for applying the copper layer corresponded to the metallization process according to the invention, except that the protection of the rack was not carried out. The part of the rack which came into contact with the various treatment solutions in the metallization process is completely coated by a copper layer. FIG. 2B shows a corresponding part of a rack after a plastic surface of an article in the form of a plate which has been fastened in the rack has been copper-plated with inclusion of the protection of the rack. The plastic surface of the article bears a homogeneous copper layer, while the plastic casing of the rack has not been copper-plated. The plastic casing of the rack additionally bears a black-green colour which is caused by long use of the rack.

Treatment with iodate ions is particularly advantageous when process step C ii), in one embodiment of the invention, consists of electroless metallizing of the articles in a metallization solution.

The iodate ions are of sufficient stability in aqueous solution and are consumed only through drag-out. Generally, the effect of the protection of the rack increases with rising concentration of the iodate ions and with rising operating temperature. Finding of the optimum concentration is described in working example 1. The protection of the rack is executed at a temperature of 20° C. to 70° C., more preferably of 45° C. to 55° C. The iodate ions are in the form of metal iodates. The metal iodates are selected from the group comprising sodium iodate, potassium iodate, magnesium iodate, calcium iodate and the hydrates thereof. The concentration of the metal iodates is between 5 g/l and 50 g/l, preferably from 15 g/l to 25 g/l. The duration of the treatment of the rack with iodate ions is between 1 and 20 minutes, preferably between 2 and 15 minutes and more preferably between 5 and 10 minutes.

The solution comprising iodate ions may further comprise an acid. Inorganic acids are preferred. The inorganic acids are selected from the group comprising sulphuric acid and phosphoric acid, preferably sulphuric acid. The acid concentration is 0.02 mol/l to 2.0 mol/l, preferably 0.06 mol/l to 1.5 mol/l, more preferably 0.1 mol/l to 1.0 mol/l, based in each case on a monobasic acid. In the case of use of sulphuric acid, particular preference is given to concentrations of 5 g/l 96% sulphuric acid to 50 g/l 96% sulphuric acid, corresponding to an acid concentration of 0.1 mol/l to 1.0 mol/l based on a monobasic acid.

The described composition of the solution comprising iodate ions and temperature and duration for the treatment of the rack are independent of the juncture in the process according to the invention at which the protection of the rack takes place.

Moreover, the treatment of the rack with a solution comprising iodate ions shows a reservoir effect. The effect of the protection of the racks, namely the prevention of metal deposition on the racks, continues over one or more metallization cycles. A metallization cycle in the context of this invention is understood to mean a metallization process which includes process steps A) to D) already described, but not the treatment of the rack with a solution comprising iodate ions. In each metallization cycle, unmetallized articles are fastened to the racks and used to produce metallized articles. The process according to the invention comprising the treatment of the rack with a solution comprising iodate ions is performed, and then one to four metallization cycles are performed. During the process according to the invention and during the metallization cycles, articles are metallized. The rack is metallized neither during the process according to the invention nor during the subsequent metallization cycles, even though the metallization cycles do not include the treatment of the rack with a solution comprising iodate ions. The treatment of the rack with a solution comprising iodate ions during the process according to the invention is sufficient to avoid metallization of the racks even during one to four subsequent metallization cycles.

The process of the present invention further comprises process step C), in which a plastic surface is treated with a solution of a metal colloid or of a compound of a metal.

The metal of the metal colloid or of the metal compound is selected from the group comprising the metals of transition group I of the Periodic Table of the Elements (PTE) and transition group VIII of the PTE.

The metal of transition group VIII of the PTE is selected from the group comprising palladium, platinum, iridium, rhodium and a mixture of two or more of these metals. The metal of transition group I of the PTE is selected from the group comprising gold, silver and a mixture of these metals.

A preferred metal in the metal colloid is palladium. The metal colloid is stabilized with the protective colloid. The protective colloid is selected from the group comprising metallic protective colloids, organic protective colloids and other protective colloids. As a metallic protective colloid, preference is given to tin ions. The organic protective colloid is selected from the group comprising polyvinyl alcohol, polyvinylpyrrolidone and gelatine, preferably polyvinyl alcohol.

In a preferred embodiment of the invention, the solution of the metal colloid in process step C) is an activator solution with a palladium/tin colloid. This colloid solution is obtained from a palladium salt, a tin(II) salt and an inorganic acid. A preferred palladium salt is palladium chloride. A preferred tin(II) salt is tin(II) chloride. The inorganic acid may consist in hydrochloric acid or sulphuric acid, preferably hydrochloric acid. The colloid solution forms through reduction of the palladium chloride to palladium with the aid of the tin(II) chloride. The conversion of the palladium chloride to the colloid is complete; therefore, the colloid solution no longer contains any palladium chloride. The concentration of palladium is 5 mg/l-100 mg/l, preferably 20 mg/l-50 mg/l and more preferably 30 mg/l-45 mg/l, based on $Pd^{2+}$. The concentration of tin(II) chloride is 0.5 g/l-10 g/l, preferably 1 g/l-5 g/l and more preferably 2 g/l-4 g/l, based on $Sn^{2+}$. The concentration of hydrochloric acid is 100 ml/l-300 ml/l (37% by weight of HCl). In addition, a palladium/tin colloid solution additionally comprises tin(IV) ions which form through oxidation of the tin(II) ions. The temperature of the colloid solution during process step C) is 20° C.-50° C. and preferably 35° C.-45° C. The treatment time with the activator solution is 0.5 min-10 min, preferably 2 min-5 min and more preferably 3 min-5 min.

In a further embodiment of the invention, in process step C), the solution of a compound of a metal is used in place of the metal colloid. The solution of a metal compound used is a solution comprising an acid and a metal salt. The metal in the metal salt consists in one or more of the above-listed metals of transition groups I and VIII of the PTE. The metal salt may be a palladium salt, preferably palladium chloride, palladium sulphate or palladium acetate, or a silver salt, preferably silver acetate. The acid is preferably hydrochloric acid. Alternatively, it is also possible to use a metal complex, for example a palladium complex salt, such as a salt of a palladium-aminopyridine complex. The metal compound in process step C) is present in a concentration of 40 mg/l to 80 mg/l, based on the metal. The solution of the metal compound can be employed at a temperature of 25° C. to 70° C., preferably at 25° C. The treatment time with the solution of a metal compound is 0.5 min-10 min, preferably 2 min-6 min and more preferably 3 min-5 min.

Between process steps B) and C), the following further process step can be performed:

B ii) treating the plastic surface in an aqueous acidic solution.

Preference is given to performing process step B ii) between process steps B i) and C). If, in the process according to the invention, process step B i) was followed by the protection of the racks, process step B ii) is more preferably performed between the protection of the racks and process step C).

The treatment of the plastic surfaces in process step B ii) is also referred to as preliminary dipping, and the aqueous acidic solution used as a preliminary dipping solution. The preliminary dipping solution has the same composition as the colloid solution in process step C), without the presence of the metal in the colloid and the protective colloid thereof. The preliminary dipping solution, in the case of use of a palladium/tin colloid solution in process step C), comprises exclusively hydrochloric acid if the colloid solution likewise comprises hydrochloric acid. For preliminary dipping, brief immersion into the preliminary dipping solution at ambient temperature is sufficient. Without rinsing the plastic surfaces, they are treated further directly with the colloid solution of process step C) after the treatment in the preliminary dipping solution.

Process step B ii) is preferably performed when process step C) involves the treatment of a plastic surface with a solution of a metal colloid. Process step B ii) can also be performed when process step C) involves the treatment of a plastic surface with a solution of a compound of a metal.

After the treatment of the plastic surfaces with the metal colloid or the metal compound in process step C), these can be rinsed.

In a further embodiment of the invention, the following further process steps are performed between process steps C) and D):

C i) treating the plastic surface in an aqueous acidic solution and

C ii) electrolessly metallizing the plastic surface in a metallizing solution.

The embodiment is shown schematically in Table 1.

TABLE 1

Embodiment of plastic metallization

| Process step | Constituents | Time | Temperature |
|---|---|---|---|
| A) Fastening | — | — | — |
| A i) Pretreatment | Glycol compound as organic solvent in water | 2-15 min | 35-50° C. |
| B) Etching | 100 g/l sodium permanganate, 10 g/l 96% sulphuric acid | 5-15 min | 70° C. |
| B i) Reduction | 100 g/l 96% sulphuric acid, 30 ml/l hydrogen peroxide, 30% by wt. | 1 min | 45° C. |
| Rack protection | 20 g/l potassium iodate | 2-5 min | 40-60° C. |
| B ii) Preliminary dipping | Hydrochloric acid, about 10% by wt. | 1 min | 20° C. |
| C) Activation | Palladium/tin colloid in hydrochloric acid solution | 3-6 min | 20-45° C. |
| C i) Acceleration | Sulphuric acid (5%) | 2-6 min | 40-50° C. |
| C ii) Electroless metal deposition | Chemically reductive nickel-plating or copper-plating | 6-20 min | 30-50° C. |
| D) Metal deposition | For example, electrochemical copper-plating or nickel-plating | 15-70 min | 20-35° C. |

These further process steps C i) and C ii) are employed when the articles are to be metallized by an electroless metallization process, i.e. a first metal layer is to be applied to the plastic surfaces by an electroless process.

If the activation in process step C) has been performed with a metal colloid, the plastic surfaces are treated in process step C i) with an accelerator solution in order to remove constituents of the colloid in the colloid solution, for example a protective colloid, from the plastic surfaces. If the colloid in the colloid solution in process step C) is a palladium/tin colloid, the accelerator solution used is preferably an aqueous solution of an acid. The acid is selected, for example, from the group comprising sulphuric acid, hydrochloric acid, citric acid and tetrafluoroboric acid. In the case of a palladium/tin colloid, the accelerator solution helps to remove the tin compounds which served as the protective colloid.

Alternatively, in process step C i), a reductor treatment is performed when, in process step C), a solution of a metal compound has been used in place of a metal colloid for the activation. The reductor solution used for this purpose then comprises, if the solution of the metal compound was a hydrochloric acid solution of palladium chloride or an acidic solution of a silver salt, hydrochloric acid and tin(II) chloride. The reductor solution may also comprise another reducing agent, such as $NaH_2PO_2$ or else a borane or borohydride, such as an alkali metal borane or alkaline earth metal borane or dimethylaminoborane. Preference is given to using $NaH_2PO_2$ in the reductor solution.

After the acceleration or treatment with the reductor solution in process step C i), the plastic surfaces can first be rinsed.

Process step C i) and optionally one or more rinse steps are followed by process step C ii) in which the plastic surfaces are metallized electrolessly. Electroless nickel-plating is accomplished, for example, using a conventional nickel bath which comprises, inter alia, nickel sulphate, a hypophosphite, for example sodium hypophosphite, as a reducing agent, and also organic complexing agents and pH adjusters (for example a buffer). The reducing agent used may likewise be dimethylaminoborane or a mixture of hypophosphite and dimethylaminoborane.

Alternatively, it is possible to use an electroless copper bath for electroless copper-plating, the electroless copper bath typically comprising a copper salt, for example copper sulphate or copper hypophosphite, and also a reducing agent, such as formaldehyde or a hypophosphite salt, for example an alkali metal or ammonium salt, or hypophosphorous acid, and additionally one or more complexing agents such as tartaric acid, and also a pH adjuster such as sodium hydroxide.

The surface thus rendered conductive can subsequently be electrolytically further metallized in order to obtain a functional or decorative surface.

Step D) of the process according to the invention is the metallization of the plastic surface with a metallization solution. The metallization in process step D) can be effected electrolytically. For electrolytic metallization, it is possible to use any desired metal deposition baths, for example for deposition of nickel, copper, silver, gold, tin, zinc, iron, lead or alloys thereof. Such deposition baths are familiar to those skilled in the art. A Watts nickel bath is typically used as a bright nickel bath, this comprising nickel sulphate, nickel chloride and boric acid, and also saccharine as an additive. An example of a composition used as a bright copper bath is one comprising copper sulphate, sulphuric acid, sodium chloride and organic sulphur compounds in which the sulphur is in a low oxidation state, for example organic sulphides or disulphides, as additives.

The effect of the metallization of the plastic surface in process step D) is that the plastic surface is coated with metal, the metal being selected from the above-listed metals for the electrolytic deposition baths. At the same time, the protection of the rack has the effect that the rack is not, or the racks are not, coated with metal and thus remain free from metal.

In a further embodiment of the invention, after process step D), the following further process step is performed:

D i) storage of the metallized plastic surface at elevated temperature.

As in all electroplating processes in which a nonconductor is coated by wet-chemical means with metal, the adhesion strength between metal and plastic substrate increases in the first period after the application of the metal layer. At room temperature, this process is complete after about three days. This can be accelerated considerably by storage at elevated temperature. The process is complete after about one hour at 80° C. It is assumed that the initially low adhesion strength is caused by a thin water layer which lies at the boundary between metal and nonconductive substrate and hinders the formation of electrostatic forces.

The treatment of the metallized plastic surfaces at elevated temperature is thus advantageous. Such a step may involve treating a copper-metallized article made of ABS plastic at elevated temperature in the range from 50° C. to 80° C. for a period between 5 minutes and 60 minutes, preferably at a temperature of 70° C., in a water bath, in order that the water can be distributed at the metal-plastic interface in the plastic matrix. The effect of the treatment or storage of the metallized plastic surfaces at elevated temperature is that an initial, relatively low adhesion strength is enhanced further, such that, after process step D i), an adhesion strength of the metal layer applied to the plastic surface which is within the desired range of at least or greater than 0.8 N/mm is achieved.

The process according to the invention thus enables metallization of the racks to be avoided, and simultaneously, with good process reliability and excellent adhesion strength of the subsequently applied metal layers, achievement of metallization of electrically nonconductive plastic surfaces of articles. The adhesion strength of the metal layers applied to plastic surfaces reaches values of 0.8 N/mm or higher. Thus, the adhesion strengths achieved are also well above those obtainable according to the prior art. In addition, the process according to the invention is suitable not just for metallizing planar plastic surfaces but also inhomogeneously shaped plastic surfaces, for example shower heads, with successful avoidance of the metallization of the racks.

The treatment of the plastic surfaces by the process according to the invention is preferably performed in a conventional dipping process, by dipping the articles successively into solutions in vessels, in which the respective treatment takes place. In this case, the articles may be dipped into the solutions either fastened to racks or accommodated in drums. Fastening to racks is preferred. Alternatively, the articles can also be treated in what are called conveyor plants, by lying, for example, on trays and being conveyed continuously through the plants in horizontal direction.

WORKING EXAMPLES

The working examples described hereinafter are intended to illustrate the invention in detail.

Example 1

Inventive Example

An ABS moulding (shower head) was fastened to a PVC-coated holding rack (process step A)). For this example, an old holding rack having a particularly strong tendency to rack metallization was selected. The moulding was dipped for ten minutes into a solution of 15% 2-(2-ethoxyethoxy)ethyl acetate and 10% butoxyethanol which had been adjusted to pH=7 with a potassium phosphate buffer and was kept at 45° C. in a thermostat (process step A i)). Subsequently, the moulding was rinsed under running water for one minute and then treated in a bath of 100 g/l sodium permanganate and 10 g/l 96% sulphuric acid, which was kept at 70° C. (process step B)). A treatment time of 10 minutes was again followed by rinsing under water and removal of adhering manganese dioxide in a solution of 50 g/l 96% sulphuric acid and 30 ml/l 30% hydrogen peroxide (process step B i), see Table 2). After this reaction, the rack with the ABS moulding was treated in a solution with various concentrations of potassium iodate (0, 5, 10, 20, 40 g/l) in 50 g/l 96% sulphuric acid at 50° C. for 10 minutes (protection of the rack).

Subsequent rinsing and brief dipping into a solution of 300 ml/l 36% hydrochloric acid (process step B ii) was followed by activation in a colloidal activator based on a palladium colloid (Adhemax Activator PL from Atotech, 25 ppm of palladium) for three minutes (process step C), see Table 2). Subsequent rinsing was followed by removal of the protective shells of the palladium particles at 50° C. for 5 minutes (Adhemax ACC1 accelerator from Atotech, process step C i), see Table 2). The ABS moulding was subsequently nickel-plated at 45° C. without external current for 10 minutes (Adhemax LFS, from Atotech, process step C ii)) and then rinsed.

The ABS moulding thereafter was covered with a light grey nickel layer completely and without defects. Depending on the concentration of potassium iodate in the above-described iodate solution, the PVC coating of the holding rack was coated with nickel to different extent, as illustrated in FIG. 1. While coverage of the rack with nickel of 75% of the surface area of the rack is observed without iodate treatment (0 g/l $KIO_3$ in FIG. 1), the treatment of the rack with 40 g/l $KIO_3$ already leads to negligible coverage with nickel of 2% of the surface area of the rack.

The sequence of process steps in Example 1 is summarized in Table 2.

TABLE 2

Sequence of process steps in Example 1

| Process step | Chemistry | Time | Temperature |
|---|---|---|---|
| A) Fastening | — | — | — |
| A i) Pretreatment | 15% 2-(2-ethoxyethoxy)ethyl acetate and 10% butoxyethanol in water, potassium phosphate buffer, pH = 7 | 10 min | 45° C. |
| B) Etching | 100 g/l sodium permanganate, 10 g/l 96% sulphuric acid | 10 min | 70° C. |
| B i) Reduction | 50 g/l 96% sulphuric acid, 30 ml/l hydrogen peroxide, 30% by wt. | 1 min | 45° C. |
| Rack protection | 0, 5, 10, 20, 40 g/l potassium iodate in 50 g/l 96% sulphuric acid | 10 min | 50° C. |
| B ii) Preliminary dipping | hydrochloric acid, approx. 10% by weight | 1 min | 20° C. |
| C) Activation | palladium colloid, 25 ppm of palladium | 3 min | 45° C. |
| C i) Acceleration | sulphuric acid 5% | 5 min | 50° C. |
| C ii) Electroless metal deposition | Chemically reductive nickel-plating, Adhemax LFS, from Atotech | 10 min | 45° C. |

Example 2

Inventive Example

Two so-called valve caps (round mouldings of diameter of about 7 cm) made of the plastic Novodur P2MC (ABS) were fastened to a holding rack and treated as described in Example 1. In contrast to Example 1, in process step A i), a solution of 10% ethylene glycol diacetate and 10% ethylene glycol monobutyl ether was employed. This solution was kept at 45° C., and the valve caps were treated therein for five minutes. Subsequently, all process steps of Example 1 were conducted. After the reduction (process step B i)), the rack with the valve caps was treated in a solution with 20 g/l potassium iodate in 50 g/l 96% sulphuric acid at 50° C. for ten minutes.

Electroless nickel-plating was additionally followed by electrolytic copper-plating for 70 minutes (Cupracid HT from Atotech, 3.5 A/dm$^2$, room temperature, process step D)). After rinsing, the valve caps were stored at 80° C. for 30 minutes (process step D i)). Subsequently, a tensile tester (from Instron) was used to pull the metal layer away from the plastic (ASTM B 533 1985 Reapproved 2009), and the adhesion strength was thus determined. Adhesion strengths of the metal layers to the plastic of the valve caps of 1.14 N/mm and 1.17 N/mm were found.

The coverage of the rack with metal was 4% of the rack surface area and was thus likewise negligible.

Example 3

Influence of Glycol Treatment on the Adhesion Strength of the Metals Applied

Panels of Bayblend T45 (ABS/PC mixture) were treated in a 15% solution of 2-(2-ethoxyethoxy)-ethyl acetate and 10% butoxyethanol which had been adjusted to pH=7 with a potassium phosphate buffer at 45° C. for different periods. Subsequently, the panels were rinsed under running water for about one minute and then introduced into a bath of 100 g/l sodium permanganate and 10 g/l 96% sulphuric acid, which was kept at 70° C. A treatment time of ten minutes was again followed by rinsing under water for one minute, and the now dark brown panels were cleaned to remove deposited manganese dioxide in a solution of 50 g/l 96% sulphuric acid and 30 ml/l 30% hydrogen peroxide. After subsequent rinsing and brief dipping into a solution of 300 ml/l 36% hydrochloric acid, the panels were activated in a colloidal activator based on a palladium colloid (Adhemax Aktivator PL from Atotech, 25 ppm of palladium) at 45° C. for three minutes.

After subsequent rinsing, the protective shells of the palladium particles were removed at 50° C. for five minutes (Adhemax ACC1 accelerator from Atotech). The panels were subsequently nickel-plated at 45° C. without external current for ten minutes (Adhemax LFS, from Atotech), rinsed and copper-plated at 3.5 A/dm$^2$ at room temperature for 70 minutes (Cupracid HT, from Atotech). After rinsing, the panels were stored at 80° C. for 1 hour. Subsequently, a knife was used to cut out a strip of each metallized plastic panel of width about 1 cm, and a tensile tester (from Instron) was used to pull the metal layer away from the plastic (ASTM B 533 1985 Reapproved 2009).

Figure 3:
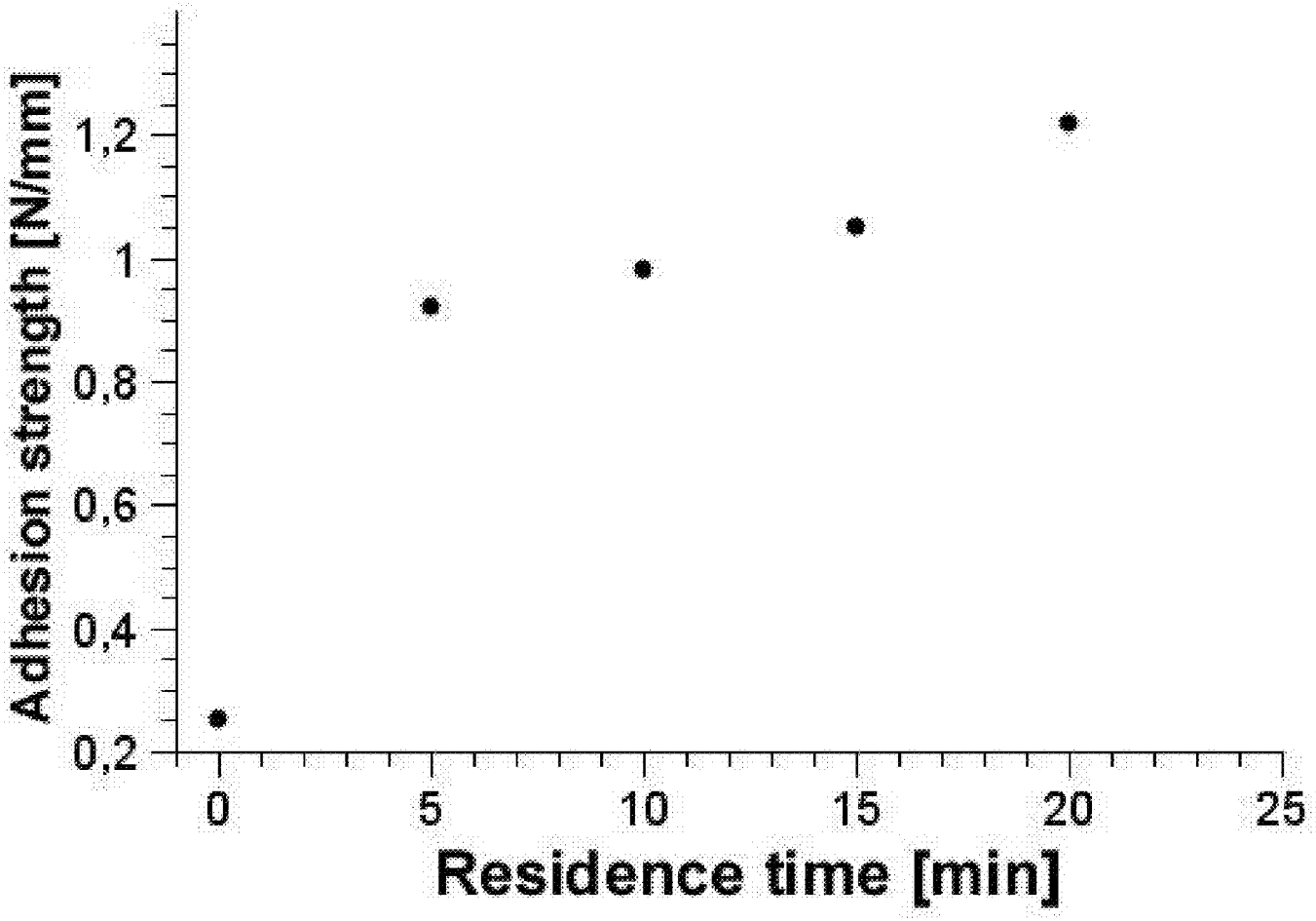
FIG. 3: Influence of the treatment time of articles made from an ABS/PC mixture with glycol compounds on adhesion strength.

The adhesion strengths of the metal layers are shown in FIG. 3 and summarized in Table 3. The residence time of the plastic surfaces in the solution of the glycol compounds (process step A i)) has an influence on the adhesion strength of the metal layers applied. Without treatment with glycol compounds (residence time 0 min in FIG. 3), only an adhesion strength of 0.25 N/mm was obtained. After treatment with glycol compounds for only 5 minutes, in contrast, a good adhesion strength of 0.92 N/mm was already achieved, and this rises further with longer treatment time.

TABLE 3

Adhesion strength of a metal layer after treatment of the ABS/PC article with glycol compounds for different periods.

| Residence time [min] | Adhesion strength [N/mm] |
|---|---|
| 0 | 0.25 |
| 5 | 0.92 |
| 10 | 0.98 |
| 15 | 1.05 |
| 20 | 1.22 |

Example 4

Influence of Glycol Treatment on the Adhesion Strength of the Metals Applied

Panels of ABS plastic (Novodur P2MC) were, as described in Example 3, treated with a 15% solution of 2-(2-ethoxyethoxy)ethyl acetate and 10% butoxyethanol for different periods of time and subjected to the further metallization process, and the adhesion strengths of the metal layer applied were determined.

Figure 4:
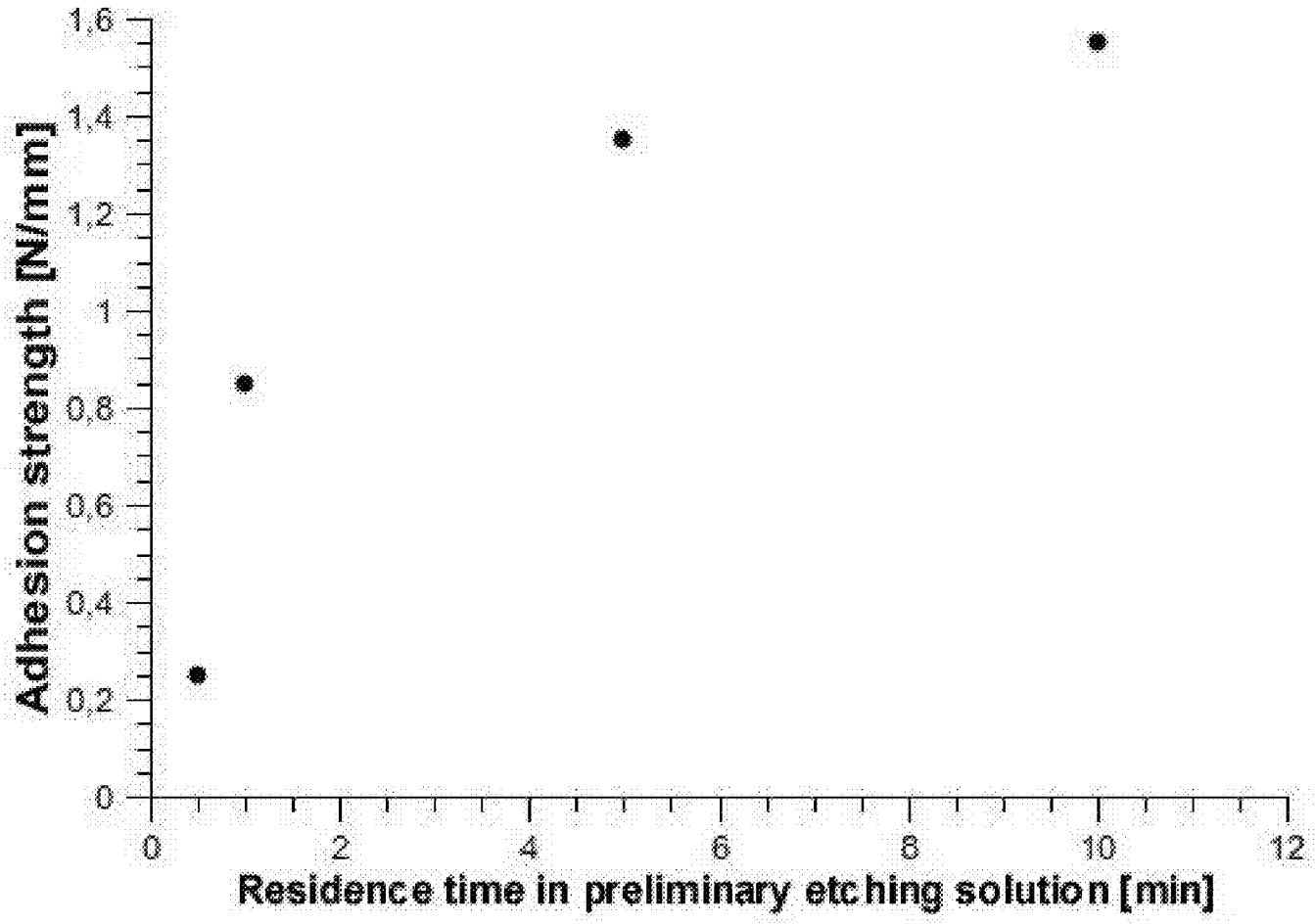
FIG. 4: Influence of the treatment time of articles made from ABS with glycol compounds on adhesion strength.

The adhesion strengths of the metal layer as a function of the treatment time with the solution of the glycol compounds are shown in FIG. 4 and summarized in Table 4. Here too, the influence of the treatment time (referred to in FIG. 4 as residence time in the preliminary etching solution) on the adhesion strength of the metal layers applied is clearly evident. Without treatment with glycol compounds (residence time 0 min in FIG. 4), only an adhesion strength of 0.25 N/mm was obtained. After treatment with glycol compounds for only 5 minutes, in contrast, a very good adhesion strength of 1.35 N/mm was already achieved, and this rises further with longer treatment time.

TABLE 4

Adhesion strength of a metal layer after treatment of the ABS article with glycol compounds for different periods.

| Residence time [min] | Adhesion strength [N/mm] |
|---|---|
| 0.5 | 0.25 |
| 1.0 | 0.85 |
| 5.0 | 1.35 |
| 10.0 | 1.55 |

Example 5

Influence of Glycol Treatment on the Adhesion Strength of the Metals Applied

Two panels of Bayblend T45 (5.2×14.9×0.3 cm, ABS/PC mixture) were treated in a 40% solution of 2-(2-ethoxyethoxy)ethyl acetate at room temperature for ten minutes. After rinsing, as described in Example 3, the panels were subjected to the further metallization process and the adhesion strengths of the metal layer applied were determined.

The following adhesion strengths were found:

| | | |
|---|---|---|
| Panel 1 | front side: 1.09 N/mm. | reverse side: 1.27 N/mm |
| Panel 2 | front side: 1.30 N/mm. | reverse side: 1.32 N/mm |

Example 6

Two ABS panels (dimensions: 15.0 cm×5.1 cm×0.3 cm) were fastened to two PVC-coated holding racks (process step A)). For this example, old holding racks having a particularly strong tendency to rack metallization were selected. The panels were dipped for ten minutes into a solution of 15% 2-(2-ethoxyethoxy)ethyl acetate and 10% butoxyethanol which had been adjusted to pH=7 with a potassium phosphate buffer and was kept at 45° C. in a thermostat (process step A i)). Subsequently, the panels were rinsed under running water for one minute and then treated in a bath of 100 g/l sodium permanganate and 10 g/l 96% sulphuric acid, which was kept at 70° C. (process step B)). A treatment time of 10 minutes was again followed by rinsing under water and removal of adhering manganese dioxide in a solution of 25 ml/l 96% sulphuric acid and 30 ml/l 30% hydrogen peroxide (process step B i), see Table 6). After this reaction, one of the racks with an ABS panel was treated in a solution of 20 g/l potassium iodate 10 ml/l 96% sulphuric acid at 60° C. for 10 minutes (protection of the rack, rack 1 with panel 1). For the other rack with a panel the treatment with iodate solution was omitted (rack 2 with panel 2).

Subsequently, both panels were rinsed and briefly dipped into a solution of 300 ml/l 36% hydrochloric acid (process step B ii). These steps were followed by activation in a colloidal activator based on a palladium colloid (Adhemax NA from Atotech, 25 ppm of palladium) for five minutes (process step C), see Table 6). Subsequent rinsing was followed by removal of the protective shells of the palladium particles at 50° C. for 4 minutes (Adhemax ACC1 accelerator from Atotech, process step C i), see Table 6). The ABS panels were subsequently nickel-plated at 45° C. without external current for 10 minutes (Adhemax Ni LFS, from Atotech, process step C ii)) and then rinsed.

Afterwards panel 1 was electrolytically copper-plated for 60 minutes (Cupracid HT from Atotech, 3.5 A/dm$^2$, room temperature, process step D)). After rinsing, the panel was stored at 75° C. for 30 minutes (process step D i)). Subsequently, the adhesion strength was determined as described in Example 2. Results are summarized in Table 5 and the sequence of process steps in Example 6 is summarized in Table 6.

TABLE 5

Results of Example 6

| | |
|---|---|
| Rack 1 (with iodate treatment) | About 25% of rack area was coated with nickel. |
| Rack 2 (no iodate treatment) | Complete area of rack was nickel coated. |
| Panel 1 (with iodate treatment) | Complete area of panel was plated with nickel and copper. Adhesion strength of nickel-copper layers: 1.14 N/mm, 1.10 N/mm, 1.12 N/mm, mean value: 1.12 ± 0.02 N/mm |
| Panel 2 (no iodate treatment) | Complete area of panel was plated with nickel. |

TABLE 6

| Sequence of process steps in Example 6 | | | |
|---|---|---|---|
| Process step | Chemistry | Time | Temperature |
| A) Fastening | — | — | — |
| A i) Pretreatment | 15% 2-(2-ethoxyethoxy)ethyl acetate and 10% butoxyethanol in water, potassium phosphate buffer, pH = 7 | 10 min | 45° C. |
| B) Etching | 100 g/l sodium permanganate, 10 g/l 96% sulphuric acid | 10 min | 70° C. |
| B i) Reduction | 25 ml/l 96% sulphuric acid, 30 ml/l hydrogen peroxide, 30% by wt. | 1 min | 45° C. |
| Rack protection, optionally | 20 g/l potassium iodate in 10 ml/l 96% sulphuric acid | 10 min | 60° C. |
| B ii) Preliminary dipping | hydrochloric acid, approx. 10% by weight | 1 min | 20° C. |
| C) Activation | palladium colloid, 25 ppm of palladium | 5 min | 35° C. |
| C i) Acceleration | sulphuric acid 5% | 4 min | 50° C. |
| C ii) Electroless metal deposition | Chemically reductive nickel-plating, Adhemax Ni LFS, from Atotech | 10 min | 45° C. |
| D) Metal deposition | electrochemical copper-plating, Cupracid HT from Atotech, 3.5 A/dm$^2$ | 60 min | 20° C. |
| D i) Storage | — | 30 min | 75° C. |

Example 7

An ABS panel (same dimensions as in Example 6) was treated as described in Example 6. In contrast to Example 6 the etching step (step B) and the reducing step (step B i) were omitted and replaced by the treatment with an iodate solution (step: rack protection). The sequence of process steps in Example 7 is summarized in Table 7.

RESULTS

Rack: Complete area of rack was nickel coated.

Panel: Complete area of panel was plated with nickel. Nickel layer did not adhere to the panel surface.

Example 8

An ABS panel (same dimensions as in Example 6) was treated as described in Example 6. In contrast to Example 6 the treatment with an iodate solution (step: rack protection) was performed after the activation step (step C). An overview of the sequence of process steps in Example 8 is given in Table 7.

RESULTS

Rack: No nickel deposition at all.

Panel: No nickel deposition at all.

Example 9

An ABS panel (same dimensions as in Example 6) was treated as described in Example 6. In contrast to Example 6 the accelerating step (step C i) was omitted and replaced by the treatment with an iodate solution (step: rack protection). The sequence of process steps in Example 9 is summarized in Table 7.

RESULTS

Rack: No nickel deposition at all.

Panel: No nickel deposition at all.

TABLE 7

| Overview of the sequence of process steps in Examples 7 to 9. | | |
|---|---|---|
| Process steps Example 7 | Process steps Example 8 | Process steps Example 9 |
| A) Fastening | A) Fastening | A) Fastening |
| A i) Pretreatment | A i) Pretreatment | A i) Pretreatment |
| Rack protection | B) Etching | B) Etching |
| — | B i) Reduction | B i) Reduction |
| B ii) Preliminary dipping | B ii) Preliminary dipping | B ii) Preliminary dipping |
| C) Activation | C) Activation | C) Activation |
| — | Rack protection | — |
| C i) Acceleration | C i) Acceleration | Rack protection |
| C ii) Electroless metal deposition | C ii) Electroless metal deposition | C ii) Electroless metal deposition |

The invention claimed is:

1. Process for metallizing electrically nonconductive plastic surfaces of articles, comprising the separate process steps of:

A) fastening the article to a rack,

B) etching the plastic surface with an etching solution;

C) treating the plastic surface with a solution of a metal colloid or of a compound of a metal, the metal being selected from the metals of transition group I of the Periodic Table of the Elements and transition group VIII of the Periodic Table of the Elements, and D) metallizing the plastic surface with a metallizing solution;

wherein the rack is treated with a solution comprising iodate ions and the treatment of the rack with a solution comprising iodate ions is performed prior to process step C).

2. Process according to claim 1, wherein the treatment of the rack with a solution comprising iodate ions takes place prior to process step A) or takes place between process steps A and B) or takes place between process steps B) and C).

3. Process according to claim 1, wherein the following further process step is performed between process steps A) and B):

A i) treating the plastic surface in an aqueous solution comprising at least one glycol compound.

4. Process according to claim 3, wherein the at least one glycol compound is selected from compounds of the general formula (I)

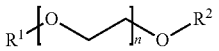

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —$CH(CH_3)$—$CH_2$—$CH_2$—$CH_3$, —$CH_2$—$CH(CH_3)$—$CH_2$—$CH_3$, —$CH_2$—$CH_2$—$CH(CH_3)$—$CH_3$, —$CH(CH_2$—$CH_3)$—$CH_2$—$CH_3$, —$CH_2$—$CH(CH_2$—$CH_3)$—$CH_3$, —CO—$CH_3$, —CO—$CH_2$—$CH_3$, —CO—$CH_2$—$CH_2$—$CH_3$, —CO—$CH(CH_3)$—$CH_3$, —CO—$CH(CH_3)$—$CH_2$—$CH_3$, —CO—$CH_2$—$CH(CH_3)$—$CH_3$, —CO—$CH_2$—$CH_2$—$CH_2$—$CH_3$.

5. Process according to claim 1, wherein the plastic surface has been manufactured from at least one electrically nonconductive plastic and the at least one electrically nonconductive plastic is selected from an acrylonitrile-butadiene-styrene copolymer, a polyamide, a polycarbonate and a mixture of an acrylonitrile-butadiene-styrene copolymer with at least one further polymer.

6. Process according to claim 1, wherein the following further process step is performed between process steps B) and C):

B i) treating the plastic surface in a solution comprising a reducing agent for manganese dioxide.

7. Process according to claim 6, wherein the reducing agent for manganese dioxide is selected from hydroxylammonium sulphate, hydroxylammonium chloride and hydrogen peroxide.

8. Process according to claim 1, wherein the iodate ions are in the form of metal iodates.

9. Process according to claim 8, wherein the metal iodates are selected from sodium iodate, potassium iodate, magnesium iodate, calcium iodate and the hydrates thereof.

10. Process according to claim 8, wherein the concentration of the metal iodates is between 5 g/l and 50 g/l.

11. Process according to claim 1, wherein the solution comprising iodate ions further comprises an inorganic acid.

12. Process according to claim 11, wherein the inorganic acid is selected from sulphuric acid and phosphoric acid.

13. Process according to claim 11, wherein the inorganic acid is in a concentration ranging from 0.02 mol/l to 2.0 mol/l based on a monobasic acid.

14. Process according to claim 1, wherein the treatment of the rack with a solution comprising iodate ions takes between 1 and 20 minutes.

15. Process according to claim 1, wherein the treatment of the rack with a solution comprising iodate ions is executed at a temperature between 20° C. and 70° C.

16. Process according to claim 2, wherein the following further process step is performed between process steps A) and B):

A i) treating the plastic surface in an aqueous solution comprising at least one glycol compound.

17. Process according to claim 16, wherein the at least one glycol compound is selected from compounds of the general formula (I)

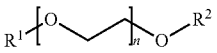

(I)

wherein n is an integer from 1 to 4; and $R^1$ and $R^2$ are each independently —H, —$CH_3$, —$CH_2$—$CH_3$, —$CH_2$—$CH_2$—$CH_3$, —$CH(CH_3)$—$CH_3$, —$CH_2$—$CH_2$—$CH_2$—$CH_3$, —$CH(CH_3)$—$CH_2$—$CH_3$, —$CH_2$—$CH(CH_3)$—$CH_3$, —$CH_2$—$CH_2$—$CH_2$—$CH_2$—$CH_3$, —$CH(CH_3)$—$CH_2$—$CH_2$—$CH_3$, —$CH_2$—$CH(CH_3)$—$CH_2$—$CH_3$, —$CH_2$—$CH_2$—$CH(CH_3)$—$CH_3$, —$CH(CH_2$—$CH_3)$—$CH_2$—$CH_3$, —$CH_2$—$CH(CH_2$—$CH_3)$—$CH_3$, —CO—$CH_3$, —CO—$CH_2$—$CH_3$, —CO—$CH_2$—$CH_2$—$CH_3$, —CO—$CH(CH_3)$—$CH_3$, —CO—$CH(CH_3)$—$CH_2$—$CH_3$, —CO—$CH_2$—$CH(CH_3)$—$CH_3$, —CO—$CH_2$—$CH_2$—$CH_2$—$CH_3$.

18. Process according to claim 2, wherein the following further process step is performed between process steps B) and C):

B i) treating the plastic surface in a solution comprising a reducing agent for manganese dioxide.

19. Process according to claim 3, wherein the following further process step is performed between process steps B) and C):

B i) treating the plastic surface in a solution comprising a reducing agent for manganese dioxide.

20. Process according to claim 16, wherein the following further process step is performed between process steps B) and C):

B i) treating the plastic surface in a solution comprising a reducing agent for manganese dioxide.

* * * * *